US010214269B2

(12) United States Patent
Skrydstrup

(10) Patent No.: US 10,214,269 B2
(45) Date of Patent: Feb. 26, 2019

(54) FOLDING PROPELLER

(71) Applicant: Flexofold ApS, Vejle (DK)

(72) Inventor: Jack Skrydstrup, Egtved (DK)

(73) Assignee: FLEXOFOLD APS, Vejle (DK)

( * ) Notice: Subject to any disclaimer, the term of this patent is extended or adjusted under 35 U.S.C. 154(b) by 298 days.

(21) Appl. No.: 15/029,359

(22) PCT Filed: Oct. 14, 2014

(86) PCT No.: PCT/DK2014/050330

§ 371 (c)(1),
(2) Date: Apr. 14, 2016

(87) PCT Pub. No.: WO2015/055210

PCT Pub. Date: Apr. 23, 2015

(65) Prior Publication Data

US 2016/0272292 A1 Sep. 22, 2016

(30) Foreign Application Priority Data

Oct. 14, 2013 (DK) ..... 2013 70583

(51) Int. Cl.
*B63H 1/22* (2006.01)

(52) U.S. Cl.
CPC ..... *B63H 1/22* (2013.01)

(58) Field of Classification Search
CPC ..... B63H 1/20; B63H 1/22; B63H 1/24
USPC ..... 416/142, 244 B, 93 A
See application file for complete search history.

(56) References Cited

U.S. PATENT DOCUMENTS

| | | | | |
|---|---|---|---|---|
| 725,097 A | 4/1903 | Learnard | | |
| 4,086,025 A | 4/1978 | Åstrand | | |
| 4,275,991 A * | 6/1981 | Soderbaum | B63H 1/24 | 416/134 R |
| 4,424,004 A * | 1/1984 | Hiskes | F01D 5/06 | 138/89 |
| 5,403,217 A | 4/1995 | Vosper | | |
| 6,371,726 B1 * | 4/2002 | Jonsson | B63H 1/24 | 416/131 |

FOREIGN PATENT DOCUMENTS

| | | |
|---|---|---|
| DE | 295 01 828 U1 | 3/1995 |
| DK | 94 00089 U3 | 4/1994 |
| GB | 190801331 A | 4/1908 |
| WO | 97/15489 A1 | 5/1997 |

* cited by examiner

*Primary Examiner* — Justin Seabe
(74) *Attorney, Agent, or Firm* — David S. Safran; Roberts Mlotkowski Safran Cole & Calderon, P.C.

(57) ABSTRACT

A folding propeller for a boat, e.g., for a sailboat or a multihull yacht, and a method for installing and/or adjusting such a folding propeller, where said folding propeller has a hub for directly or indirectly fastening at a driveshaft connected to a motor, where said folding propeller further has at least two individual blades, where each of said blades has a root arranged to pivot around a pivot pin at said hub to be either in a first, operative position, where the blades are pointing mainly in a radial direction, and in a second, inoperative position, where the blades are pointing mainly in an axial direction, where said hub has one or more cut outs for said blades roots and further has a first set of holes for installing said pivot pins and a second set of holes for installing a locking device for engagement with said pivot pins.

8 Claims, 4 Drawing Sheets

FOLDING PROPELLER

BACKGROUND OF THE INVENTION

Field of the Invention

The present invention relates to a folding propeller for a boat, e.g., for a sailboat or a multihull yacht, where said folding propeller comprises a hub for directly or indirectly fastening at a driveshaft connected to a motor, where said folding propeller further comprises at least two individual blades, where each of said blades comprises a root arranged to pivot around a pivot pin at said hub in order to either be in a first and operative position, where the blades are pointing mainly in a radial direction, or in a second and inoperative position, where the blades are pointing mainly in an axial direction, where said hub comprises one or more cut outs for said blade roots and further comprises a first set of holes for installing said pivot pins and a second set of holes for installing said locking means for engagement with said pivot pins. The invention further comprises a method for installing and/or adjusting such a folding propeller.

Description of Related Art

It is well known that boats such as sailboats and multihull yachts use folding propellers in order to minimize drag, noise and wear when sailing without use of the auxiliary propelling means—a motor. Using a folding propeller will prevent that the propeller is rotated by the water and creates drag and noise when sailing and not using the motor, but further there is much less tendency for the propeller to get tangled up in fishing lines, rope and other articles that otherwise would accumulate on the propeller.

Another rather important issue when it comes to propellers for boats is corrosion and effectiveness. Galvanic corrosion can be limited by using sacrificial anodes that will be corroded instead of the propeller hub and blades. Another important subject is the effectiveness of the propeller, which can be compromised rather drastically due to fouling on the propeller parts. Until now the design of folding propellers did not address the problem with fouling very well. Further when the folding propeller has been used for some time and a little wear has occurred, there is no way of adjusting the individual blades neither in relation to the hub nor in relation to the other blades at the hub.

U.S. Pat. No. 5,403,217 describes a folding blade propeller for a power vessel, wherein the folding blade propeller comprises a hub for directly or indirectly mounting on a driving shaft, where the folding blade propeller further comprises at least two propeller blades, where each of the propeller blades comprises a base arranged to turn around each own pivot pin at the mentioned hub for in that way to be in either a first operative position, where the propeller blades are pointing in a mainly radial direction, or to be in another and inoperative position, where the propeller blades are pointing in a mainly axial direction, and where the mentioned hub comprises one or several cut outs for the mentioned bases and a first set of holes for inserting of the mentioned pivot pins.

SUMMARY OF THE INVENTION

It is an object of the invention to provide a folding propeller that is rather corrosion resistant, has a low moment of inertia, and where slack between the individual parts of the folding propeller can be adjusted according to production tolerances and to wear. It is also an object of the invention to provide a folding propeller, where the mechanism for taking up the forces acting on the propeller when operated, comprises a closed mechanical system allowing for the use of a low tensile strength material for parts of the propeller.

Further, it is an object of the invention to provide a folding propeller that is quieter that the known folding propellers when changing from forward to reverse, and even further it is an objective of the invention to provide a method for performing an adjustment of a folding propeller.

As mentioned above, the invention relates to a folding propeller for a boat, e.g., for a sailboat or a multihull yacht, where said folding propeller comprises a hub for directly or indirectly fastening at a driveshaft connected to a motor, where said folding propeller further comprises at least two individual blades, where each of said blades comprises a root arranged to pivot around a pivot pin at said hub in order to either be in a first and operative position, where the blades are pointing mainly in a radial direction, or in a second and inoperative position, where the blades mainly are pointing in an axial direction, where said hub comprises one or more cut outs for said blade roots and further comprises a first set of holes for installing said pivot pins and a second set of holes for installing said locking means for engagement with said pivot pins.

The novel and inventive thing is that said pivot pins comprise means for installation of said locking means, where the locking means are installed in a first pivot pin and further are engaging a second pivot pin.

Said locking means can be a fastener such as a bolt or a screw, herein after referred to as a bolt, where said fastener is installed through an opening in a first pivot pin and further into a threaded hole in another pivot pin. This allows for the first pivot pin and the second pivot pin to be pulled towards each other and at the same time to be held and secured in relation to the hub. Such an arrangement can be arranged at each end of a pivot pin, and thus a hub comprising e.g., two or three pivot pins can comprise two or three pivot pins having the exact same design, as at one end of a pivot pin there is an opening for a fastener to pass through, and at the other end there is a threaded hold for another fastener to be fastened. This will be discussed in detail in the description of the figures and especially when describing FIG. 4 and FIG. 7.

The pivot pins and the locking means/fasteners can be regarded as a closed structure that holds the propeller blades at the roots of the propeller blades. Thus, the hub itself has a less important role, as the reactions form the centrifugal forces, when the propeller is driven, will mainly be taken up by said closed structure of the pivot pins and the locking means and thus to spare the hub from said reactions.

In order to secure said locking means in position in the threaded holes in the pivot pins, the fasteners/locking means can be secured with thread-locking adhesive and/or by engaging narrow holes in the hub. Securing the locking means by engaging narrow holes in the hub means that the locking means extends through the pivot pin and into a hole in the hub, where said hole is an extension of the hole for the locking means. Such a narrow hole might comprise threads or the hub might be manufactured from a material that will allow the locking means to cut itself into position in the hole.

In an embodiment of a folding propeller according to the invention said hub can be manufactured from a plastic material, e.g., POM, PET, PA, from a fiber reinforced polymer material and/or from another material having similar properties, where POM means polyacetal, PET means polyethylene terephthalate and PA means polyamide. Other types of polymers and thermo setting materials with suitable properties may also be used for said hub. The mentioned properties of said materials can, e.g., be mechanical, electrical and/or chemical properties, where a material for a specific use is chosen according to specific and relevant properties.

Manufacturing a hub from a plastic/polymer material has several advantages which will become clear below.

A hub made from plastics has the advantage of being an electrical insulator preventing or at least minimizing corrosion of the metal parts of the hub. Further plastic is a cheap material that is easy to machine and strong enough to transfer the torque of the motor.

The locking means mentioned above can be secured in narrow holes in the hub by having the locking means in the shape of bolts extend through said threaded opening and into a narrow hole in the plastic hub material. The threads of the bolts will thus cut itself into the plastic material and thus prevent the bolt from becoming loose over time.

A hub made from a polymer also has a considerable lower weight and thus also less inertia when rotating and especially when changing between forward and reverse rotation of the propeller, which is one of the situations where the prior art folding propellers experience a high load due to a relatively high weight of the hub itself.

A folding propeller according to the invention can have two, three or even four blades, but in most situations two blades is the best and most optimum solution and the blades will typically be manufactured from a metal alloy comprising Ni, Al, Cu, bronze and/or other copper and stainless steel alloys that will be suitable for this purpose.

In an embodiment of a folding propeller according to the invention, said hub can be manufactured from a metal alloy, e.g., bronze, stainless steel or another suitable metal alloy. The material used for the hub can in principle be any suitable material, metallic or not and no matter if the hub is made from a polymer or from a metal alloy one or more anodes can be arranged at the hub in order to protect against galvanic corrosion on the parts of the folding propeller.

In a preferred embodiment of a folding propeller according to the invention, said hub comprises a link, where said link comprises means for interacting with at least two of said pivot pins and with at least two of said propeller blade roots. Such a link can be compared to the side plate of a roller chain, where the link has openings for receiving the pivot pins and thus supports the locking means or bolts, which holds the opposing pivot pin in place during operation. The link is actually a kind of safety strap helping the locking means and also relieving the load on the hub. Thus, the hub can be manufactured from a less strong and solid material such as the known metal alloys and instead be manufactured from a polymer as mentioned above. Such a link can be arranged in a manner that allows for an anode to be installed to said link using high corrosion resistant bolts.

In yet an embodiment of a folding propeller according to the invention, said hub at the cut out for the blade root of the blades may comprise at least one internal flange dividing said cut out, where said internal flange comprises means for interacting with at least two of said pivot pins and with at least two of said propeller blade roots. Said internal flange is actually a kind of link as discussed above, but here the flange is an integrated part of the hub that is situated in said cut out and that fits into corresponding cut outs in the propeller blade roots and thus allows the root of the blades to be installed on both sides of the flange, and further allows that the pivot pins are installed through the hub, the root of the blades and into said flange and further into the root and finally into the hub. More or less in the same manner as when having a link as mentioned above, which will be discussed in detail below.

Another possibility of supporting the folding propeller construction according to the invention can comprise that the hub comprises at least one link, but preferably at least two links, where said one or more links can be embedded in the material of the hub, where said link or links comprise means for interacting with at least two of said pivot pins and with at least two of said propeller blade roots. The links can, e.g., be steel links fully embedded in the hub and as such adding rigidity to the hub and to the system of pivot bolts and locking means.

In an attractive variant of a folding propeller according to the invention, said folding propeller may comprise two, three or four individual blades, each blade having a root comprising a gear engaging one or more other gears at other blade roots. Using gears at the root of the propeller blades secures a simultaneous engagement of both/all propeller blades when engaging the drive shaft. The propeller blades are forced into the operative position by the centrifugal forces, and by using the gears it is secured that all blades will be activated in an equal manner and thus the system—the folding propeller—will be in an optimum balance. A folding propeller according to the invention may however be designed with blades without such a gear.

According to the invention a folding propeller may have a hub comprising at least one compression cut out between said first set of holes for the pivot pins. A compression cut out can for instance be made as one or more drilled or machined apertures between said first set of holes. A compression cut out can also be made as a reduced material thickness, a material with a higher elasticity/less stiffness or in any other possible manner, that allow the first set of holes or the pivot pins arranged therein to be forced/adjusted towards each other, e.g., by tightening the locking means/bolts.

In a further embodiment of a folding propeller according to the invention, said folding propeller may comprise shock absorber means, said shock absorber means being arranged at one or more blade roots. Such shock absorber means reduce the impact forces transferred to the hub when activating the propeller and unfolding the blades. The shock absorber means can be arranged as parts of a resilient material, e.g., a rubber compound, installed at the propeller blade roots in order for the shock absorber to be engaged with the hub or alternatively to be engaged with an opposing propeller blade root as will be seen in the figures below.

The invention also relates to a method for installing and/or adjusting a folding propeller according to the invention and as described above. The new and inventive method comprises at least the following steps:

- determining a too small or a too large clearance between a number of individual blades of a folding propeller;
- activating the locking means that engages one pivot pin through another pivot pin, and either loosening or tightening said locking means;
- determining that a proper clearance has been achieved.

During installation of a two bladed folding propeller according to the invention the propeller will be disassembled more or less completely. The hub, the propeller blades and the pivot pins and the locking means will be separated in order to install the hub at the drive shaft. After having installed the hub and secured it in position, the first propeller blade is arranged and aligned with the root in the cut out in the hub and the first pivot pin is inserted in the hub and through the root of the blade and into the other side of the hub. After having installed the first propeller blade, the second propeller blade is arranged and aligned with the root in the cut out in the hub and the second pivot pin is inserted as the first. After having inserted the first and second pivot pin it is time to install the locking means, i.e., threaded bolts into holes perpendicular to the respective holes for the pivot pins. The bolt can be inserted in a through hole in the first pivot pin and further into a threaded hole in the second pivot pin and vice-versa with the bolt inserted in the second pivot pin. Said locking means/bolts can be installed using thread-locking adhesive. After having all parts in place, the clearance or slack between the respective propeller blades and the hub can be controlled and/or adjusted by tightening the locking means to a specific torque. The desired adjustment can also be obtained using a feeler gauge blade or other kinds of appropriate tools.

The correct clearance is important for several reasons, but mainly too much clearance will increase wear and noise whereas too little clearance will prevent the folding and unfolding motion in taking place as desired.

If the folding propeller has been in service for some time a routine service may be performed by loosening the locking means, cleaning their threads or perhaps replacing the locking means before adding thread-locking adhesive and refitting the locking means. In order to perform such a service it might be a good idea to operate one locking means at the time, and when all the locking means have been loosened and refitted the proper torque can be applied to the locking means one by one. Such a service can for instance be carried out during winter time where the boat is taken out of the water anyway, however, it is also possible to perform such a service while the boat is in the water.

An embodiment of the invention will now be described, by way of example only, with reference to the accompanying drawings.

DETAILED DESCRIPTION OF THE INVENTION

In the following text, the figures will be described one by one and the different parts and positions seen in the figures will be numbered with the same numbers in the different figures. Not all parts and positions indicated in a specific figure will necessarily be discussed together with that figure.

DETAILED DESCRIPTION OF THE INVENTION

Figure 1:
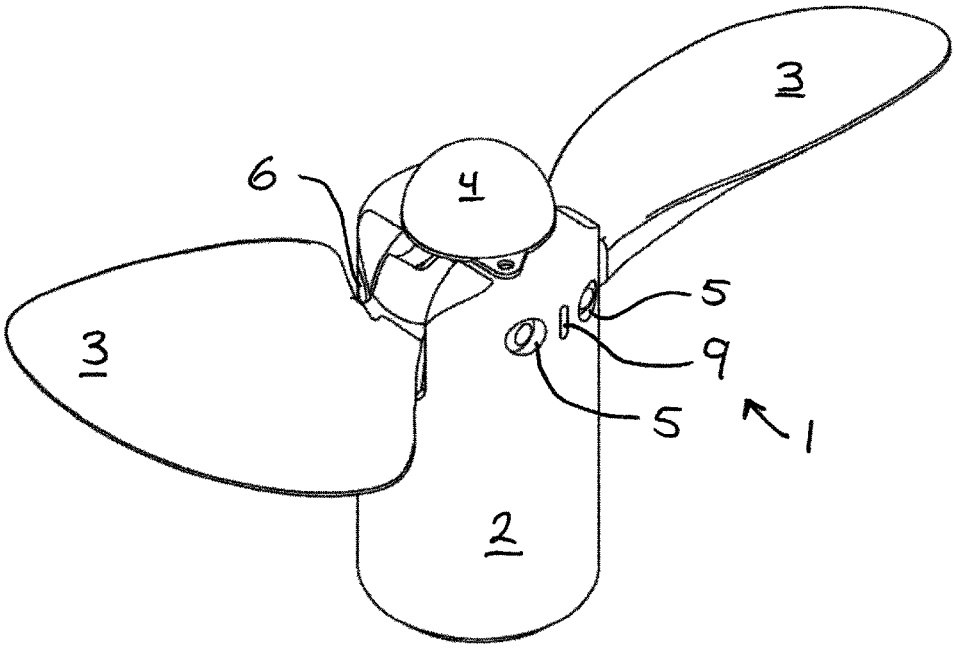
FIG. 1 shows a two bladed folding propeller in an operative position.

In FIG. 1 a two bladed folding propeller 1 is seen in an operative position, where the blades 3 are unfolded and extending in a more or less radial direction from the hub 2. At the end of the hub 2 an anode 4 is seen and on the side of the hub 2 the first set of holes 5 in the hub 2 is seen. In said first set of holes 5 the pivot pins 7 are arranged and secured.

Figure 2:
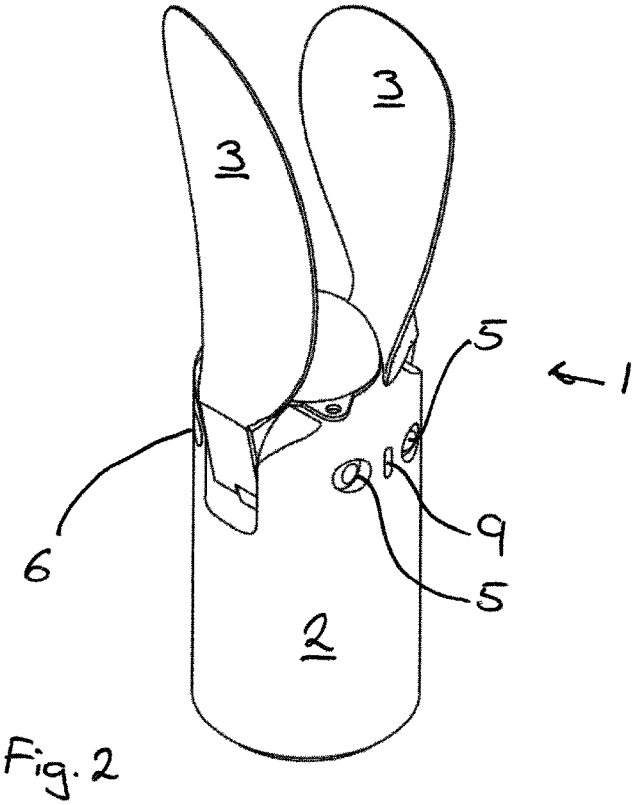
FIG. 2 shows a two bladed folding propeller in an inoperative position.

FIG. 2 show the same folding propeller 1 as seen in FIG. 1, but here, in an inoperative position, with the blades 3 folded and pointing in an axial direction.

Figure 3:
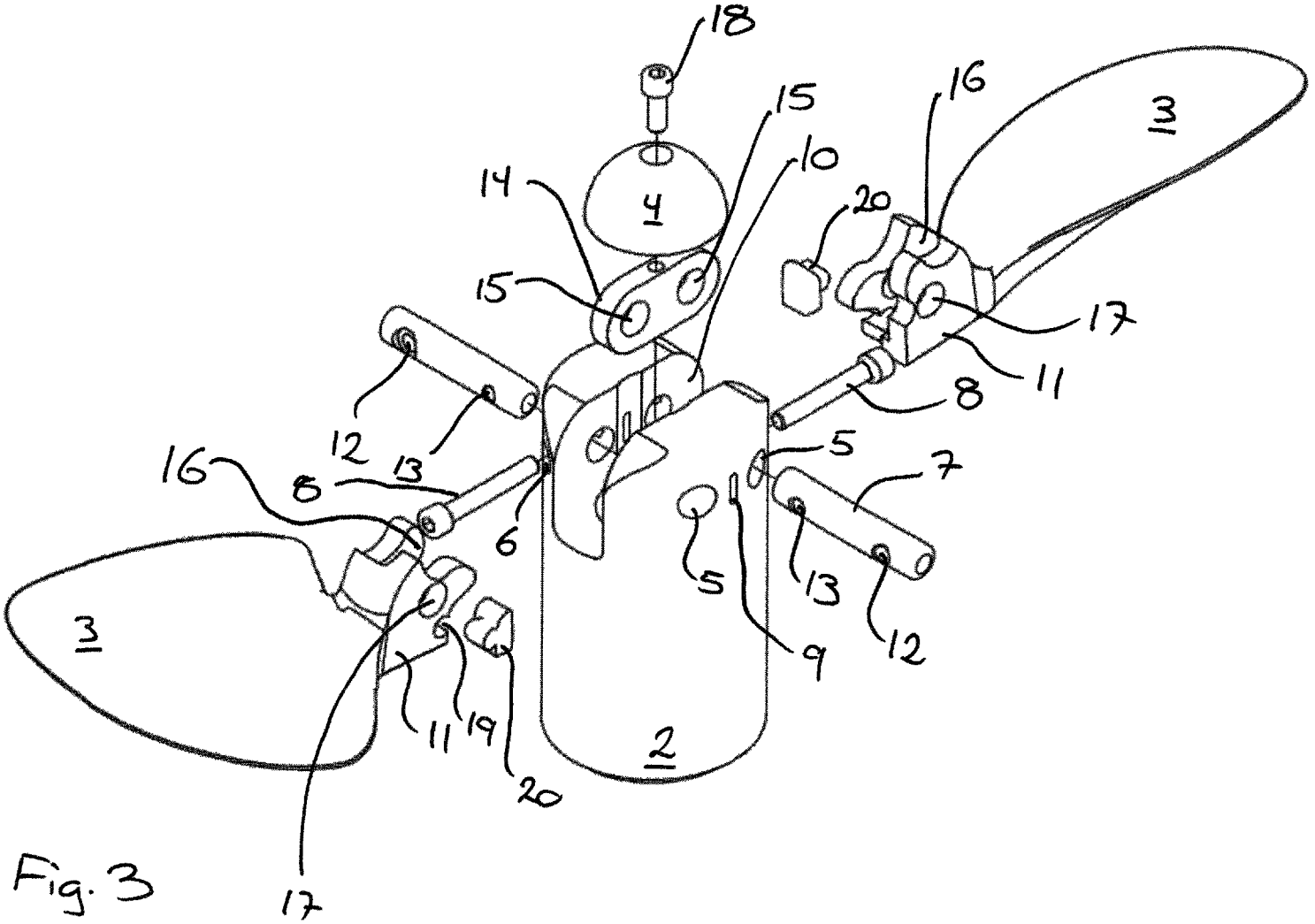
FIG. 3 shows a two bladed folding propeller disassembled.

In FIG. 3 the same two bladed folding propellers 1, as also seen in the preceding figures, are seen, but here in a completely disassembled state, where all the various parts are seen. As can be seen the hub 2 comprises said first set of holes 5 and also a second set of holes 6 arranged perpendicular to the first set of holes 5 and in the same plane. In the second set of holes 6 the locking means 8, here in the shape of threaded bolts 8, will be installed. Between the two holes of the first set of holes 5 a so called compression cut out 9 is seen. The compression cut out 9 is actually an area that it is possible to compress and thus to adjust the distance between the two holes in the first set of holes 5. Said adjustment possibility is not very large but can, e.g., be between 0.1 to 3 millimeters or less or even more. In this embodiment the compression cut out 9 is actually a longhole arranged between the holes 5, but could also have comprised a weakened area due to reduced thickness, stiffness or by any other means.

Perpendicular to the first set of holes 5, there is a cut out 10 for the propeller blade roots 11. When the propeller blades 3 are arranged in said cut out 10 the pivot pins 7 will be installed in the holes 5 and the bolts 8 will be installed in the second set of holes 6 in the hub 2. By tightening the bolts 8 the roots 11 will be pulled together and the gear at the roots will have the desired slack or clearance in order to work properly.

The pivot pins 7 each have a through hole 12 and a threaded hole 13. A locking means/bolt 8 will be installed through said through hole 12 and into engagement with said threaded hole 13 in order to adjust the distance between the two pivot pins 7.

Above the cut out 10 in the hub 2 a link 14 is seen, said link 14 has a set of holes 15 arranged for the pivot pins 7 to fit into. Further the propeller blade roots 11 also have a cut out 16 for the link to be positioned in. Then the pivot pin 7 can be installed in the holes 5 of the hub 2, and pushed into a corresponding hole 17 in the propeller blade root 11, into said link 14 and further through the other side of the propeller blade root 11 and into its final position in the hub 2 at the other side. After having installed both pivot pins 7, the locking means/bolts 8 will be installed and adjustment will take place.

In this figure, the link 14 has a first purpose of supporting the pivot pins 7 and thus to relieve the hub 2 from some of the reactive forces from the blades 3 when the propeller 1 is operated. A second purpose is to act as a support for the anode 4 that is fastened to the link 14 by a bolt 18.

At the propeller blade roots 11, a cut out 19 for a shock absorber 20 is seen. The shock absorber 20 will typically be made from a rubber compound and can be changed due to wear during dismantling of the folding propeller 1.

Figure 4:
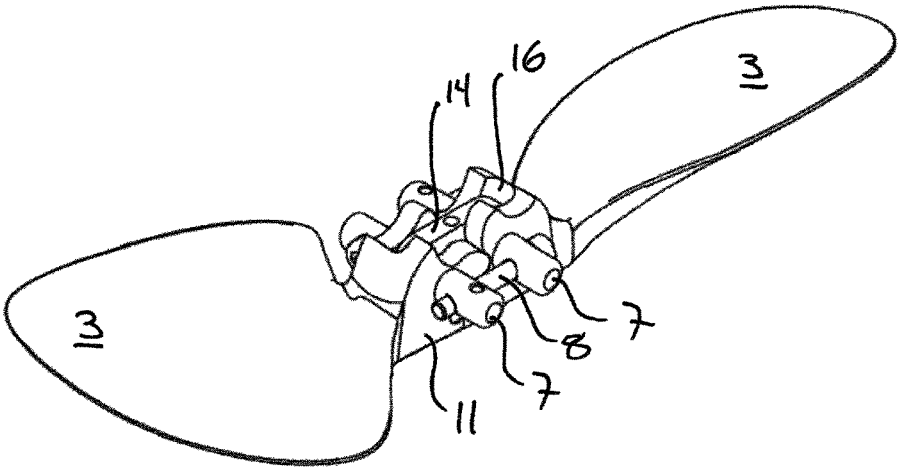
FIG. 4 shows one embodiment of the propeller blades assembled without the hub.

In FIG. 4, only the blades 3, the pivot pins 7, the locking means 8 and the central link 14 are seen installed without the hub 2. This is, of course, a unrealistic situation, but for the purpose of understanding the position of the various parts it makes sense. The same goes for FIGS. 5 and 6.

Here it can be seen that the two pivot pins 7 have identical design and that the locking means/bolts 8 are installed in a through hole 12 in one pivot pin 7 and into a threaded hole 13 in the other pivot pin 7. This design makes the locking means 8 and the pivot pins 7 together with the propeller blade roots take up practically all the mechanical loads, and thus the hub 2 can be manufactured from less rigid and strong material, e.g., a suitable polymer fiber or metal reinforced or not.

Figure 5:
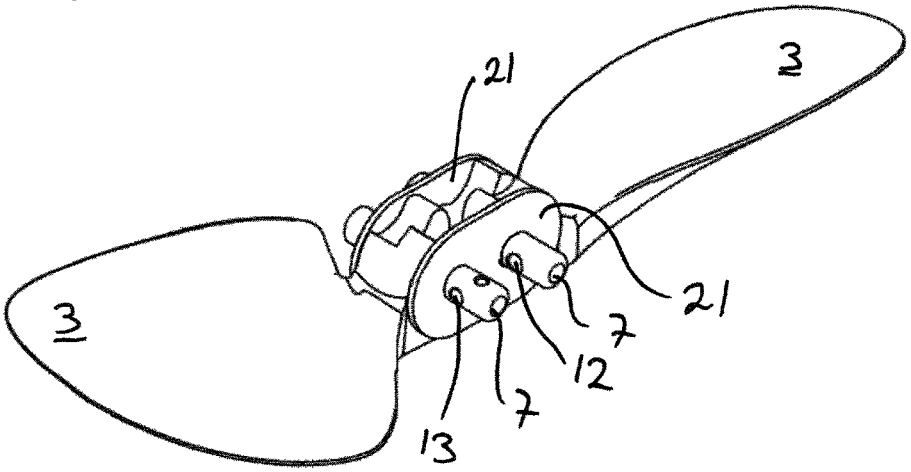
FIG. 5 shows another embodiment of the propeller blades assembled without the hub.

FIG. 5 shows an alternative solution to what is seen in FIG. 3, as the central link 14 is replaced by two side links 21. Such side links 21 can be arranged as a spacer between the sidewall of the cut out 10 in the hub 2 and the propeller blade roots 11, but these side links can also be embedded in the hub 2, e.g., during molding of such a hub 2.

Figure 6:
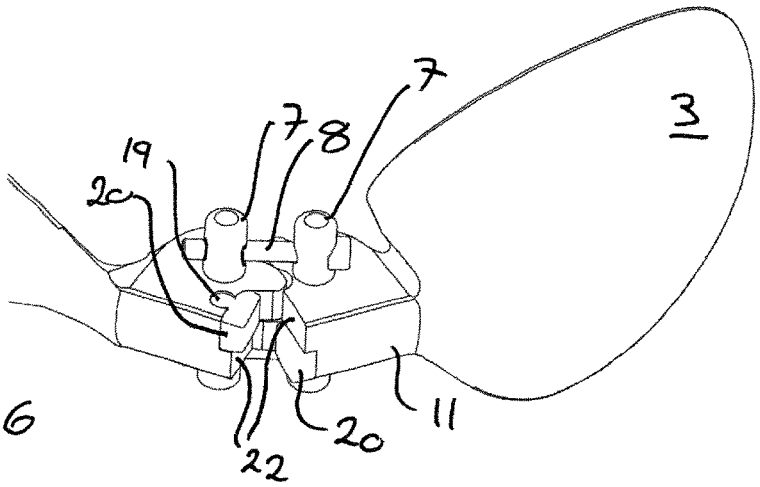
FIG. 6 shows the shock absorber element at the propeller blades.

FIG. 6 shows details about the shock absorber 20, where the contact area 22 on each of the propeller blade roots 11 is seen. The forces taken up by the shock absorber 20 is thus divided by two shock absorbers 20 and two contact areas 22.

Figure 7:
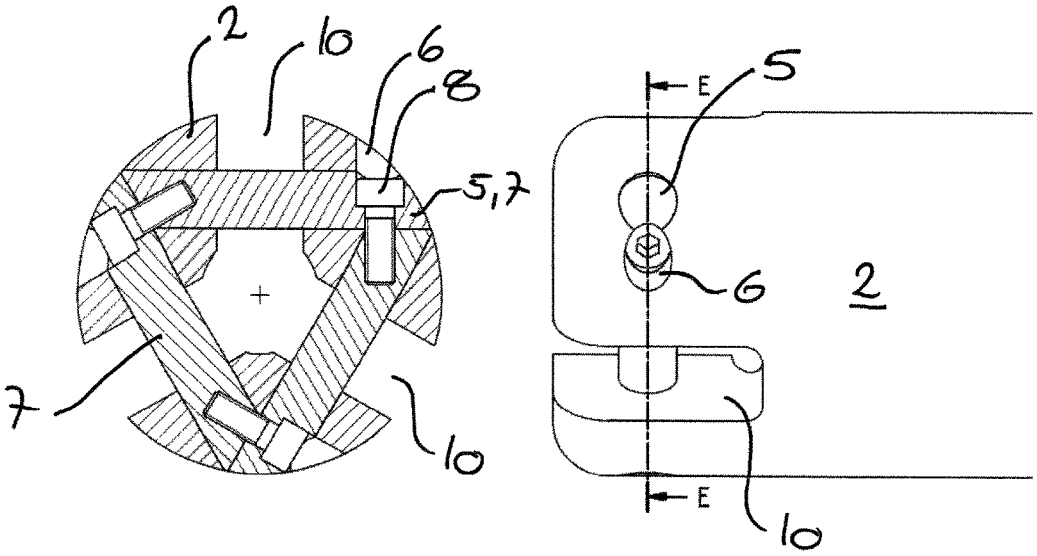
FIG. 7 shows a hub and a cross sectional drawing of the hub and pivot pins for a three bladed folding propeller.

In FIG. 7, a cross sectional drawing of a hub 2 is seen, where the hub 2 is designed for three blades 3. To the right the hub 2 is seen from the side and to the left a cross section according to the line E-E is seen, directly through the pivot pins 7. Also here the pivot pins 7 have a through hole 12 and a threaded hole 13 for the locking means/bolts 8, and the system comprising the pivot pins 7 and the locking means 8 will take up the majority of the forces and reactions at the mentioned parts.

Figure 8:
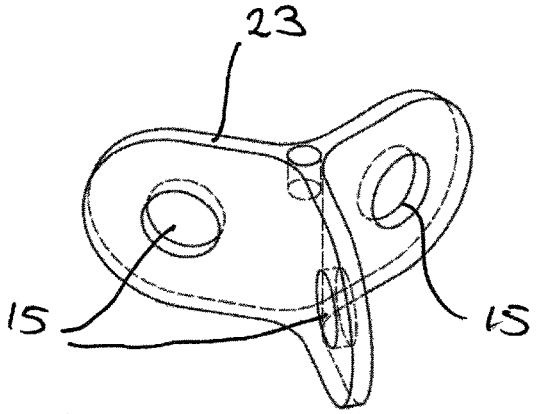
FIG. 8 shows a link for supporting the pivot pins and the hub for a three bladed folding propeller.

Finally, FIG. 8 shows a triple link 23 for the solution seen in FIG. 6, where the triple link 23 will be installed with a pivot pin 7 in each of the holes 15 in order to support the pivot pins 7 and the hub 2. Centrally at the triple link 23 there is a hole 24 for a bolt 18 for fixating an anode 4.

The invention is not limited to the embodiments described herein, and may be modified or adapted without departing from the scope of the present invention as described in the patent claims.

What is claimed is:

1. A folding propeller for a boat, where said folding propeller comprises a hub for at least indirectly fastening at a driveshaft connected to a motor, where said folding propeller further comprises at least two individual blades, where each of said blades comprises a root arranged to pivot around a separate pivot pin at said hub in order to be in one of a first and second position, where the first position is an operative position, where the blades are pointing mainly in a radial direction, and where the second position is an inoperative position, where the blades are pointing mainly in an axial direction, where said hub comprises at least one cut out for said blades roots and further comprises a first set of holes for installing said pivot pins and a second set of holes for installing locking means for engagement with said pivot pins, wherein each of said locking means is a bolt or screw mounted in said second set of holes, wherein each of said pivot pins comprises means form of a through hole and a threaded hole for installation of said locking means, where each fastener is installed in a first pivot pin and further is engaging a second pivot pin whereby each pivot pin is connected with two fasteners and whereby the pivot pins and the fasteners are a closed structure that holds the propeller blades at the roots of the propeller blades.

2. A folding propeller according to claim 1, wherein said hub is manufactured from a plastic material.

3. A folding propeller according to claim 1, wherein said hub is manufactured from a metal alloy.

4. A folding propeller according to claim 1, wherein said hub comprises a link, where said link comprises means for interacting with at least two of said pivot pins and with at least two of said propeller blade roots.

5. A folding propeller according to claim 1, wherein said hub comprises at least one side link in which said first set of holes is located, where said at least one side link is embedded in the material of the hub, where said at least one side link comprises means for interacting with at least two of said pivot pins and with at least two of said propeller blade roots.

6. A folding propeller according to claim 1, wherein said folding propeller comprises at least two individual blades, each blade having a root comprising a gear engaging at least one further gear at at least one further blade root.

7. A folding propeller according to claim 1, wherein said hub comprises at least one compression cut out between said first set of holes for the pivot pins.

8. A folding propeller according to claim 1, wherein said folding propeller comprises shock absorber means, said shock absorber means being arranged at at least one blade root.

* * * * *